US010601116B2

(12) United States Patent
Zhao et al.

(10) Patent No.: US 10,601,116 B2
(45) Date of Patent: Mar. 24, 2020

(54) WIRELESS TERMINAL

(71) Applicant: HUAWEI DEVICE CO., LTD., Dongguan, Guangdong (CN)

(72) Inventors: Liang Zhao, Dongguan (CN); Hanyang Wang, Reading (GB); Qing Liu, Shenzhen (CN); Huiliang Xu, Shenzhen (CN); Yi Fan, Shenzhen (CN); Yao Lan, Shenzhen (CN); Zhongying Long, Shenzhen (CN); Dongxing Tu, Shenzhen (CN)

(73) Assignee: Huawei Technologies Co., Ltd., Shenzhen, P.R. (CN)

( * ) Notice: Subject to any disclaimer, the term of this patent is extended or adjusted under 35 U.S.C. 154(b) by 0 days.

(21) Appl. No.: 16/376,597

(22) Filed: Apr. 5, 2019

(65) Prior Publication Data

US 2019/0229407 A1 Jul. 25, 2019

Related U.S. Application Data

(63) Continuation of application No. 15/481,059, filed on Apr. 6, 2017, now Pat. No. 10,297,901, which is a (Continued)

(51) Int. Cl.
*H01Q 1/24* (2006.01)
*H01Q 1/52* (2006.01)
(Continued)

(52) U.S. Cl.
CPC ..... *H01Q 1/243* (2013.01); *H01Q 1/38* (2013.01); *H01Q 1/48* (2013.01); *H01Q 1/521* (2013.01);
(Continued)

(58) Field of Classification Search
CPC ..... H01Q 1/523; H01Q 5/371; H01Q 1/48; H01Q 1/243; H01Q 21/28; H01Q 1/526; H01Q 1/521
(Continued)

(56) References Cited

U.S. PATENT DOCUMENTS 6,956,530 B2 10/2005 Kadambi et al.
7,825,861 B2 11/2010 Sato et al.
(Continued)

FOREIGN PATENT DOCUMENTS

CN 1922762 2/2007
CN 101005291 7/2007
(Continued)

OTHER PUBLICATIONS

Extended European Search Report issud in European Application No. 13882056.8 dated Jan. 19, 2016, 7 pages.
(Continued)

*Primary Examiner* — Joseph J Lauture
(74) *Attorney, Agent, or Firm* — Fish & Richardson P.C.

(57) ABSTRACT

A wireless terminal is disclosed. The wireless terminal includes a first antenna, a second antenna, a printed circuit board, a bracket, and a resonator. The first antenna is located at one side of the printed circuit board. The second antenna is located at another side of the printed circuit board. The printed circuit board functions as a metal ground of the first antenna and the second antenna. The resonator is located on the bracket. A ground point of the resonator is located on the printed circuit board. A clearance exists between the resonator and the printed circuit board.

20 Claims, 6 Drawing Sheets

Related U.S. Application Data continuation of application No. 14/522,109, filed on Oct. 23, 2014, now Pat. No. 9,698,470, which is a continuation of application No. PCT/CN2013/080395, filed on Jul. 30, 2013.

(51) Int. Cl.

| | |
|---|---|
| ***H01Q 21/28*** | (2006.01) |
| ***H01Q 5/371*** | (2015.01) |
| ***H01Q 1/48*** | (2006.01) |
| ***H01Q 5/342*** | (2015.01) |
| ***H01Q 1/38*** | (2006.01) |
| ***H01Q 9/04*** | (2006.01) |

(52) U.S. Cl.

CPC ..... *H01Q 1/523* (2013.01); *H01Q 1/526* (2013.01); *H01Q 5/342* (2015.01); *H01Q 5/371* (2015.01); *H01Q 9/0421* (2013.01); *H01Q 21/28* (2013.01)

(58) Field of Classification Search

USPC ..... 343/702, 853

See application file for complete search history.

(56) References Cited

U.S. PATENT DOCUMENTS

| | | | |
|---|---|---|---|
| 8,757,501 | B2 | 6/2014 | McCormack et al. |
| 9,698,470 | B2 | 7/2017 | Zhao et al. |
| 2006/0044195 | A1 | 3/2006 | Arkko et al. |
| 2007/0139271 | A1 | 6/2007 | Pelzer |
| 2009/0027286 | A1 | 1/2009 | Ohishi et al. |
| 2009/0058738 | A1 | 3/2009 | Samuka et al. |
| 2010/0214180 | A1 | 8/2010 | Krogerus |
| 2012/0013511 | A1 | 1/2012 | Sumi et al. |

FOREIGN PATENT DOCUMENTS

| | | | |
|---|---|---|---|
| CN | 101005291 | * | 5/2010 |
| CN | 201868574 | | 6/2011 |
| CN | 106832852 | | 6/2017 |
| EP | 1469554 | | 10/2004 |
| EP | 2518824 | | 10/2012 |
| EP | 2618423 | | 7/2013 |
| JP | 2009-33548 | | 2/2009 |
| JP | 2009-246560 | | 10/2009 |
| JP | 2011-512740 | | 4/2011 |
| JP | 2011-120071 | | 6/2011 |
| JP | 2012-253641 | | 12/2012 |
| WO | WO 2004/100312 | | 11/2004 |
| WO | WO 2009/101417 | | 8/2009 |

OTHER PUBLICATIONS

International Search Report and Written Opinion issued in International Application No. PCT/CN2013/080395 dated Apr. 3, 2014, 20 pages.

Islam, et al., "Ground Current Modification of Mobile Terminal Antennas and Its Effects", IEEE Antennas and Wireless Propagation Letters, vol. 10, 2011, p. 438-441.

Office Action issued in Japanese Application No. 2015-540994 dated May 10, 2016, 5 pages.

Office Action issued in U.S. Appl. No. 14/522,109 dated Oct. 3, 2016, 3 pages.

* cited by examiner

WIRELESS TERMINAL

CROSS-REFERENCE TO RELATED APPLICATIONS

This application is a continuation of U.S. patent application Ser. No. 15/481,059, filed on Apr. 6, 2017. The U.S. patent application Ser. No. 15/481,059 is a continuation of U.S. patent application Ser. No. 14/522,109, filed on Oct. 23, 2014, now U.S. Pat. No. 9,698,470. The U.S. patent application Ser. No. 14/522,109 is a continuation of International Application No. PCT/CN2013/080395, filed on Jul. 30, 2013. All of the aforementioned patent applications are hereby incorporated by reference in their entireties.

TECHNICAL FIELD

The present invention relates to the field of radio communications, and in particular, to a wireless terminal.

BACKGROUND

A wireless terminal with multimode (Global System for Mobile Communications (GSM)/Wideband Code Division Multiple Access (WCDMA)/Code Division Multiple Access (CDMA)/Long Term Evolution (LTE)) and receive diversity technologies is a key development direction of the industry in the future. Limited by a size of the wireless terminal, a spacing between multiple antennas on the wireless terminal is close to each other. If working frequency bands of the multiple antennas overlap, mutual coupling is caused between the multiple antennas, affecting radiation efficiency of the antennas. For example, in a diversity antenna system of the wireless terminal, a coupling effect of electromagnetic waves objectively exists between a main antenna and a diversity antenna. This coupling effect is especially strong for a low frequency diversity antenna system. An analysis of main reasons is as follows: In one aspect, the main antenna and the diversity antenna share a metal ground, the metal ground is a main radiator of the main antenna and the diversity antenna, and relatively strong common ground coupling exists between the main antenna and the diversity antenna; in another aspect, spatial coupling exists between the main antenna and the diversity antenna, and in the case of a low frequency band, the foregoing spatial coupling is relatively strong due to a small spacing between the main antenna and the diversity antenna. When the main antenna works in a transmission state, due to the coupling effect between the main antenna and the diversity antenna, the diversity antenna becomes an apparatus for "receiving and consuming" electromagnetic waves radiated from the main antenna, which reduces the radiation efficiency of the main antenna.

Currently, a method is to install a resonant device onto a metal ground between antennas, so as to change current distribution on the metal ground when the antennas are in a working state, thereby improving isolation between the antennas. However, because the resonant device is surrounded all by metals, and is a non-open structure, a part of radiated energy of the antennas is converted into heat inside the resonator due to a conduction and dielectric loss, and the radiation efficiency of the antennas is reduced.

SUMMARY

A wireless terminal is provided, so as to improve radiation efficiency of an antenna.

To solve the foregoing technical problem, embodiments of the present invention disclose the following technical solutions:

According to a first aspect, a wireless terminal is provided, which includes a first antenna, a second antenna, a printed circuit board, a bracket, and a resonator, where the first antenna is located atone side of the printed circuit board, the second antenna is located at another side of the printed circuit board, the printed circuit board functions as a metal ground of the first antenna and the second antenna, the resonator is located on the bracket, a ground point of the resonator is located on the printed circuit board, and a clearance exists between the resonator and the printed circuit board.

With reference to the foregoing first aspect, in a first possible implementation manner, the bracket is disposed on a surface of the printed circuit board or is disposed on a side surface of the printed circuit board that is perpendicular to the surface.

With reference to the foregoing first aspect, and/or the first possible implementation manner, in a second possible implementation manner, the wireless terminal further includes a housing, where the bracket is disposed on the housing of the wireless terminal.

With reference to the foregoing first aspect, and/or the first possible implementation manner, and/or the second possible implementation manner, in a third possible implementation manner, the bracket is the housing of the wireless terminal.

With reference to the foregoing first aspect, and/or the first possible implementation manner, and/or the second possible implementation manner, and/or the third possible implementation manner, in a fourth possible implementation manner, a metal layer is disposed on an upper surface of the printed circuit board, or a metal layer is disposed on a lower surface of the printed circuit board, or a metal layer is disposed in the printed circuit board.

With reference to the foregoing first aspect, and/or the first possible implementation manner, and/or the second possible implementation manner, and/or the third possible implementation manner, and/or the fourth possible implementation manner, in a fifth possible implementation manner, that the first antenna is located at one side of the printed circuit board and the second antenna is located at another side of the printed circuit board is specifically:

the first antenna and the second antenna are separately located at two opposite sides of the printed circuit board; or the first antenna and the second antenna are separately located at two adjacent sides of the printed circuit board.

With reference to the foregoing first aspect, and/or the first possible implementation manner, and/or the second possible implementation manner, and/or the third possible implementation manner, and/or the fourth possible implementation manner, and/or the fifth possible implementation manner, in a sixth possible implementation manner, that a ground point of the resonator is located on the printed circuit board is specifically:

the ground point of the resonator is located on the printed circuit board and between the first antenna and the second antenna.

With reference to the foregoing first aspect, and/or the first possible implementation manner, and/or the second possible implementation manner, and/or the third possible implementation manner, and/or the fourth possible implementation manner, and/or the fifth possible implementation manner, and/or the sixth possible implementation manner, in a seventh possible implementation manner, the resonator is specifically one of or any combination of the following:

a high and low frequency metal open stub, a closed metal stub, a metal stub in a form of a monopole antenna, or a metal stub in a shape of an inverted-F antenna.

With reference to the foregoing first aspect, and/or the first possible implementation manner, and/or the second possible implementation manner, and/or the third possible implementation manner, and/or the fourth possible implementation manner, and/or the fifth possible implementation manner, and/or the sixth possible implementation manner, and/or the seventh possible implementation manner, in an eighth possible implementation manner, the resonator is electrically connected to a lump component, and the lump component is located on the printed circuit board.

With reference to the foregoing first aspect, and/or the first possible implementation manner, and/or the second possible implementation manner, and/or the third possible implementation manner, and/or the fourth possible implementation manner, and/or the fifth possible implementation manner, and/or the sixth possible implementation manner, and/or the seventh possible implementation manner, and/or the eighth possible implementation manner, in a ninth possible implementation manner, the resonator is electrically connected to the lump component through a switch assembly, where the lump component includes at least two matching circuits, different matching circuits correspond to different working frequencies, and the switch assembly is configured to switch between the at least two matching circuits, so as to enable a resonance point of the resonator to switch between the working frequencies corresponding to the matching circuits.

In the embodiments of the present invention, a resonator is disposed on a bracket of a wireless terminal, not only is isolation between multiple antennas improved, but also the resonator can better radiate energy of the antennas because a clearance exists between the resonator and a metal printed circuit board (Printed Circuit Board, PCB). Therefore, it is avoided that the energy of the antennas flowing into the resonator is wasted in the resonator, thereby implementing secondary radiation of the energy of the antennas, and improving radiation efficiency of the antennas.

BRIEF DESCRIPTION OF THE DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DETAILED DESCRIPTION

To make a person skilled in the art better understand the technical solutions in the embodiments of the present invention, and to make the foregoing objects, features and advantages of the embodiments of the present invention more comprehensible, the technical solutions of the embodiments of the present invention are described in detail with reference to the accompanying drawings in the following.

Figure 1A:
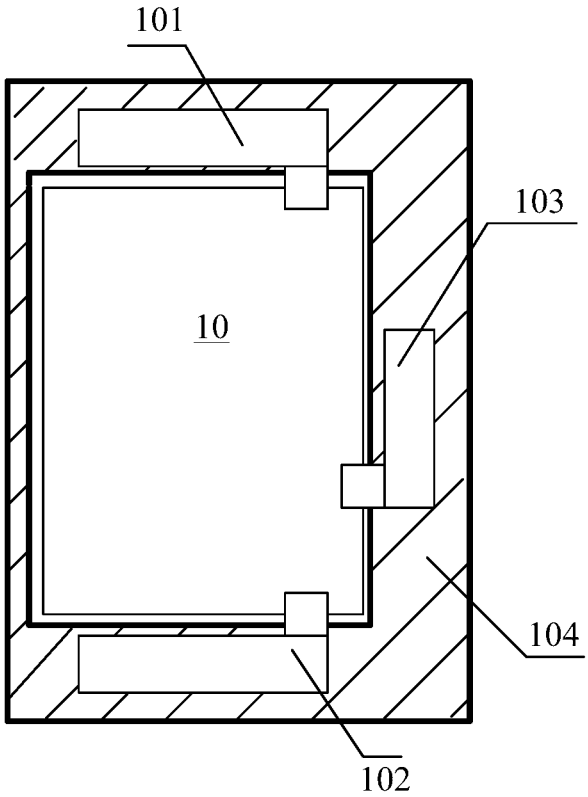
FIG. 1*a* to FIG. 1*c* are schematic structural diagrams of a wireless terminal according to embodiments of the present invention.
Figure 1B:
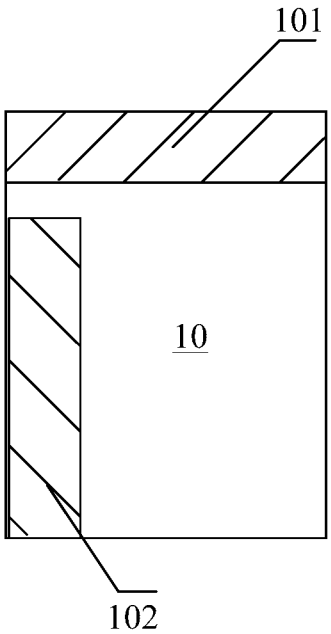
Figure 1C:
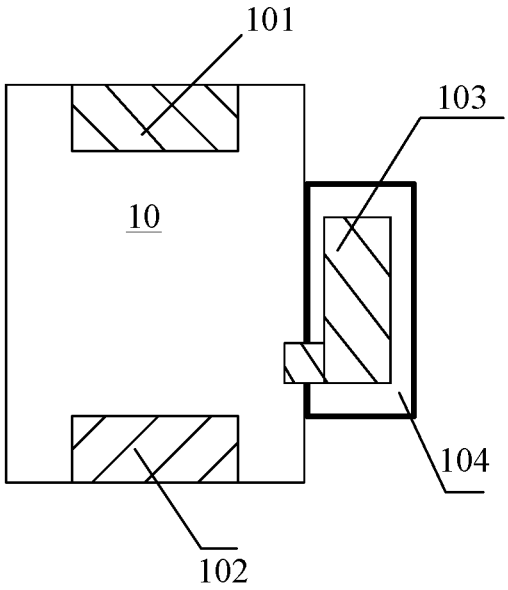

Referring to FIG. 1*a* to FIG. 1*c*, these are schematic structural diagrams of a wireless terminal according to embodiments of the present invention.

The wireless terminal includes a PCB 10, a first antenna 101, a second antenna 102, a resonator 103, and a bracket 104.

The first antenna 101 is located at one side of the PCB 10, the second antenna 102 is located at another side of the PCB 10. Specifically, the first antenna 101 and the second antenna 102 may be separately located at two opposite sides of the PCB 10, as shown in FIG. 1*a*. In another embodiment, the first antenna 101 and the second antenna 102 may further be located at two adjacent sides of the PCB 10, as shown in FIG. 1*b* (other components are not shown in the figure). The PCB 10 functions as a metal ground of the first antenna 101 and the second antenna 102, where a metal layer may be disposed on an upper surface of the PCB 10, or a metal layer may be disposed on a lower surface of the PCB 10, or a metal layer may further be disposed in the PCB 10. A material of the metal layer may be copper, or the like. The first antenna 101 and the second antenna 102 may be located on the bracket 104 and be supported by the bracket 104, as shown in FIG. 1*a*. Definitely, the first antenna 101 and the second antenna 102 may further be located on another independent antenna bracket, where the antenna bracket and the bracket 104 are separate and independent of each other. In addition, the first antenna 101 and the second antenna 102 may also be hot melted on the PCB 10, as shown in FIG. 1*c*.

The resonator 103 is located on the bracket 104 of the wireless terminal, and supported by the bracket 104. A ground point of the resonator 103 is located on the PCB 10. Specifically, the ground point may be located at a location between the first antenna 101 and the second antenna 102 and close to an edge of the PCB 10, so as to achieve a better isolation effect. A clearance of a certain dimension (for example, greater than or equal to 4 mm) exists between the resonator 103 and the PCB 10.

The bracket 104 is configured to support the resonator 103, or may further support the first antenna 101 and the second antenna 102. The bracket 104 may have multiple implementation manners. For example:

Manner 1: As shown in FIG. 1*a*, the bracket 104 may be disposed on a surface of the PCB 10, where the surface refers to a surface with the largest area on the PCB 10, or a board surface for soldering of a circuit component and the like. A surface of the bracket 104 and the surface of the PCB 10 are located on or nearly located on a same horizontal plane. Specifically, the bracket 104 may be a hollow rectangular framework. After the bracket 104 is pressed or buckled on the PCB 10, the PCB 10 is precisely embedded in the hollow position of the rectangular framework. The two opposite sides of the bracket 104 may be respectively used to support the first antenna 101 and the second antenna 102, and another side edge of the bracket 104 may be used to support the resonator 103.

Manner 2: As shown in FIG. 1*c*, the bracket 104 may be disposed on a side surface perpendicular to the foregoing surface (or the board surface) of the PCB 10, in other words, the bracket 104 is located at one side edge of the PCB 10. The bracket 104 is configured to support the resonator 103.

Manner 3: The bracket 104 may also be separated from the PCB 10, rather than be fastened or connected to the PCB 10. The bracket 104 may be fastened or connected to a housing (not shown in the figure) of the wireless terminal, where the housing is a component into which multiple parts of the wireless terminal, such as the PCB 10, the first antenna 101, the second antenna 102, and the resonator 103 are encapsulated. The housing may be formed by two components that can be buckled together to form enclosed space. The bracket 104 may be fastened or connected in the housing, and configured to support the first antenna 101, the second antenna 102, and the resonator 103. The first antenna 101 and second antenna 102 may also be hot melted on the PCB 10. The bracket 104 is configured to support the resonator 103.

Manner 4: The housing of the wireless terminal may also directly serve as the bracket 104. In this case, the first antenna 101, the second antenna 102, and the resonator 103 may all be directly printed in the housing. Definitely, the first antenna 101 and the second antenna 102 may also be hot melted on the PCB 10, and the resonator 103 is printed in the housing.

The foregoing brackets 104 may all be plastic brackets.

In the embodiment of the present invention, a resonator is disposed on a wireless terminal, not only is current distribution of a first antenna and a second antenna on a PCB changed, so that isolation between multiple antennas is improved, but also the resonator can better radiate energy of the antennas because a clearance exists between the resonator and the PCB. Therefore, it is avoided that the energy of the antennas flowing into the resonator is wasted in the resonator, thereby implementing secondary radiation of the energy of the antennas, and improving radiation efficiency of the antennas.

In another embodiment of the present invention, the resonator may be one or more of, specifically one of or any combination of, the following:

a high and low frequency metal open stub, a closed metal stub, a metal stub in a form of a monopole antenna (monopole), or a metal stub in a shape of an inverted-F antenna (Inverted-F Antenna, IFA).

Figure 2A:
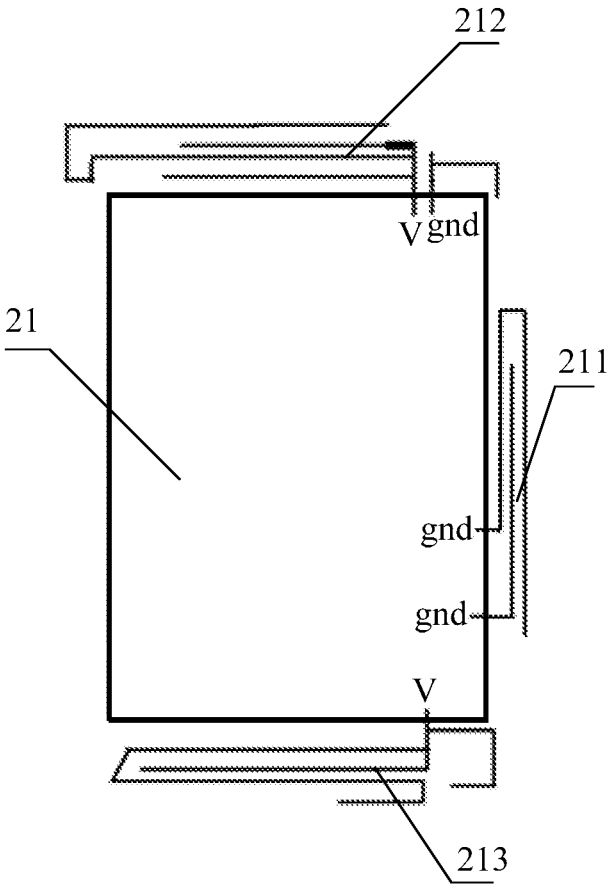
FIG. 2*a* is a schematic structural diagram of a resonator according to an embodiment of the present invention.

As shown in FIG. 2*a*, the resonator is a high and low frequency metal open stub 211, where the high and low frequency metal open stub 211 is of a structure formed by two metal strips extending from an edge of a PCB 21, and the two metal strips forma simple open structure, are compact in size, and are spaced from the PCB 21 by a clearance of a certain size. Of the two metal strips, one is long and the other is short, where the long metal strip, being a branch, resonates at a low frequency, and the short metal strip, being a branch, resonates at a high frequency. In addition, a resonance structure is relatively open, and therefore the resonator can work in multiple frequency bands and a bandwidths is relatively wide. The high and low frequency metal open stub 211 is located between a first antenna 212 and a second antenna 213.

Figure 2B:
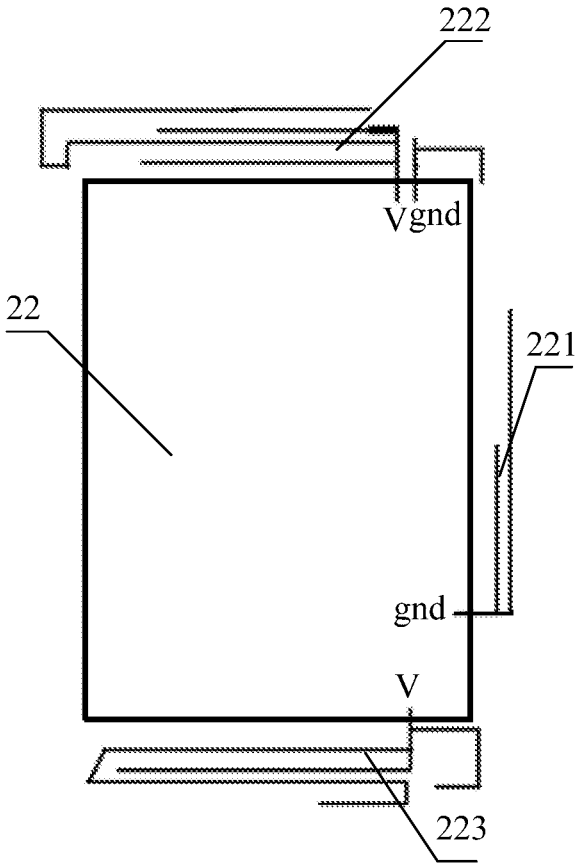
FIG. 2*b* is a schematic structural diagram of another resonator according to an embodiment of the present invention.

As shown in FIG. 2*b*, the resonator is another high and low frequency metal open stub 221, where the high and low frequency metal open stub 221 is of a structure in which one metal strip extends from an edge of a PCB 22, and after the extending, the metal strip is split into two metal strips. The two metal strips are disposed in parallel, are simple in structure, form an open structure, are compact in size, and are spaced from the PCB 22 by a clearance of a certain size. Of the two metal strips, one is long and the other is short, where the long metal strip, being a branch, resonates at a low frequency, and the short metal strip, being a branch, resonates at a high frequency. In addition, a resonance structure is relatively open, and therefore the resonator can work in multiple frequency bands and a bandwidth is relatively wide. The high and low frequency metal open stub 221 is located between a first antenna 222 and a second antenna 223.

Figure 3:
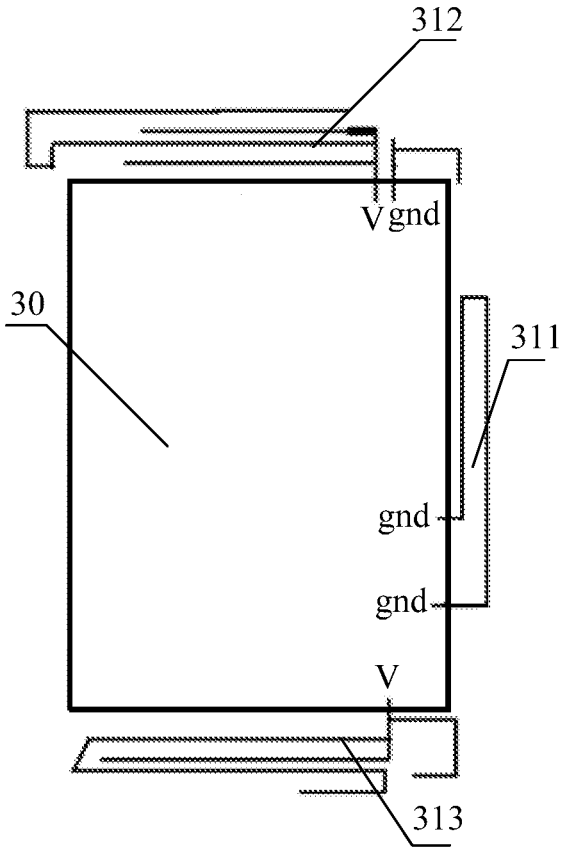
FIG. 3 is a schematic structural diagram of another resonator according to an embodiment of the present invention.

As shown in FIG. 3, the resonator is a closed metal stub 311, that is, a metal stub in a Loop form. The closed metal stub 311 is of a structure formed by a metal strip that extends from an edge of a PCB 30 and is in a shape of a closed Loop, and the metal strip in the shape of the Loop forms an open structure. A resonance frequency of a working fundamental mode (1 wavelength) of the closed metal stub 311 is at a low frequency, which may work at the low frequency, a resonance point of a higher order mode (3/2 wavelengths) of the resonator is at a high frequency, and the higher order mode of the resonator may work at the high frequency. The metal strip is of a simple structure, and is spaced from the PCB 30 by a clearance of a certain size, featuring sound radiation efficiency. The closed metal stub 311 is located between a first antenna 312 and a second antenna 313.

Figure 4:
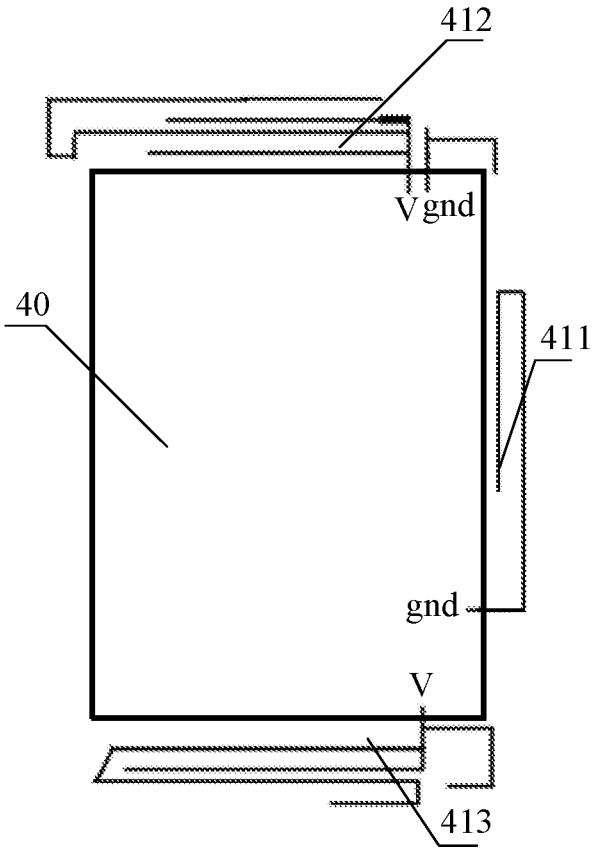
FIG. 4 is a schematic structural diagram of another resonator according to an embodiment of the present invention.

As shown in FIG. 4, the resonator is a metal stub 411 in a monopole form, where the metal stub 411 is of a structure of a C-shaped metal strip extending from an edge of a PCB 40, and the C-shaped metal strip form an open structure. A resonance point of the metal stub 411 may be close to a low frequency of 800 Mhz, a resonance point of a higher order mode (2 wavelengths) is at a high frequency, and therefore, the metal stub 411 can work at the low frequency, and the higher order mode of the resonator can work at the high frequency. The metal strip is of a simple structure, and is spaced from the PCB 40 by a clearance of a certain size, featuring sound radiation efficiency. The metal stub 411 in the monopole form is located between a first antenna 412 and a second antenna 413.

In another embodiment of the present invention, the resonator may further be electrically connected to a lump component, and the lump component may specifically be a capacitor or an inductor, or the like. One end of the lump component may be electrically connected to a junction between the resonator and the PCB, and specifically may be electrically connected to an endpoint of a metal strip of the resonator, and another end is grounded. The lump component may enable a working frequency of the resonator to be closer to a low frequency, thereby effectively reducing a structural size of the resonator.

Figure 5:
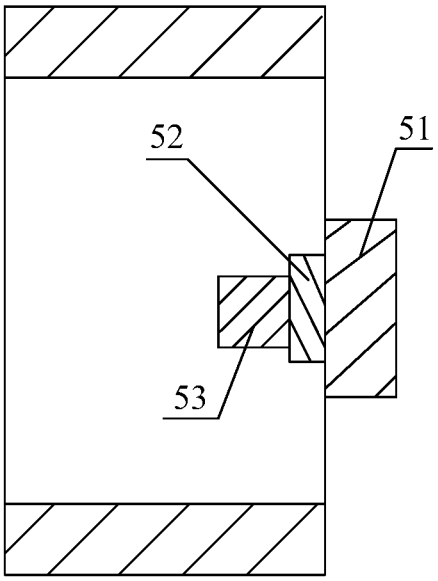
FIG. 5 is a schematic structural diagram of another wireless terminal according to an embodiment of the present invention.

In another embodiment of the present invention, as shown in FIG. 5, the resonator 51 may be electrically connected to a lump component 53 through a switch assembly 52, and the lump component 53 may be located on the PCB, where the lump component 53 includes at least two matching circuits, different matching circuits correspond to different working frequencies, and the switch assembly 52 may switch between multiple matching circuits, so that a resonance point of the resonator 51 that is of an open structure may switch between the working frequencies that correspond to the matching circuits.

Figure 6:
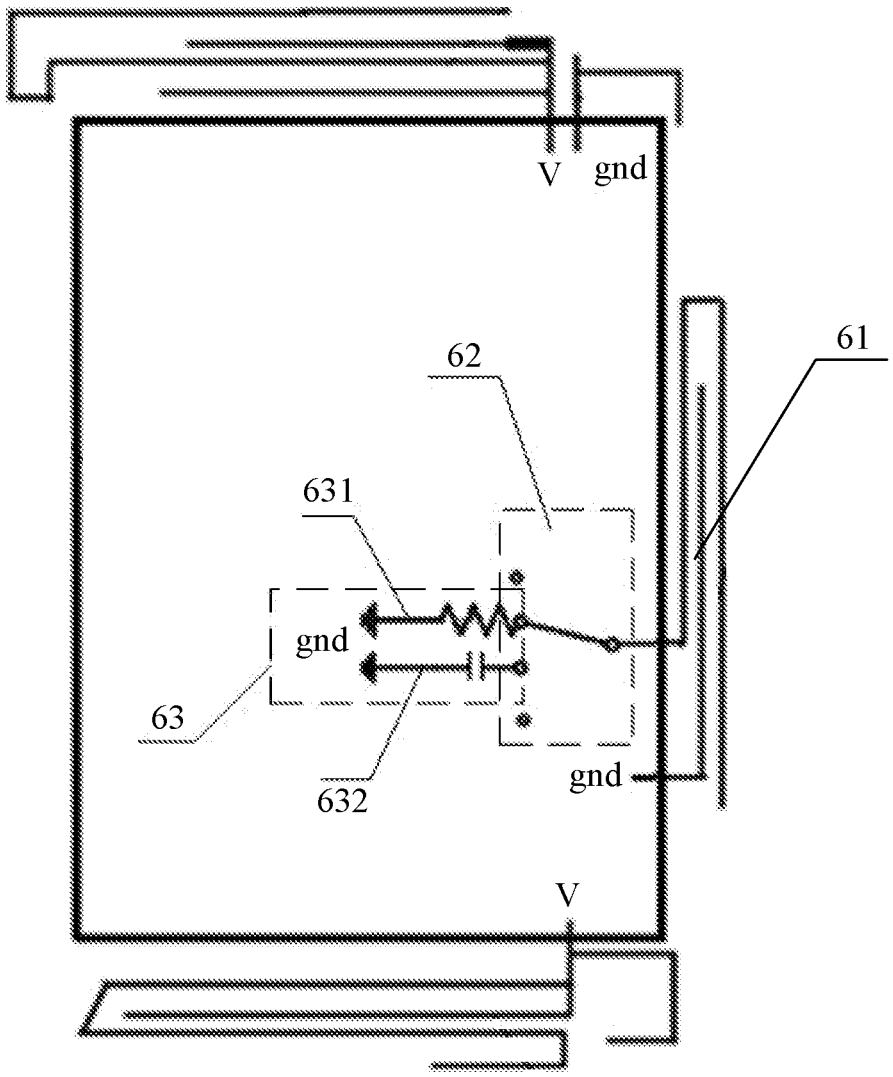
FIG. 6 is a schematic circuit diagram of a resonator, a switch assembly, and a lump component of another wireless terminal according to an embodiment of the present invention.

For example, as shown in FIG. 6, the resonator 61 that is of an open structure is electrically connected to a lump component 63 through a switch assembly 62. The lump component 63 includes two matching circuits 631 and 632, where an SMT inductor is connected in series in the matching circuit 631, a chip capacitor is connected in series in the matching circuit 632, the two matching circuits correspond to different working frequencies, and the switch assembly 62 may switch between the matching circuits 631 and 632, so that a resonance point of the resonator 61 that is of an open structure may switch between working frequencies corresponding to the matching circuits 631 and 632.

In the embodiment of the present invention, a switch assembly switches between different matching circuits, so that a resonance point of a resonator can switch between different frequencies, therefore isolation between antennas under different frequencies can be improved, and a bandwidth is increased effectively without increasing space of the resonator.

In the foregoing FIG. 2*a* to FIG. 6, for clear illustration, brackets are not shown. The brackets in the foregoing embodiments may all be implemented by using anyone of the manners of the brackets in the embodiments described above.

The wireless terminal according to the embodiments of the present invention may be a mobile terminal such as a mobile phone, CPE, or a gateway. The wireless terminal may improve isolation between multiple antennas and multiple frequency bands, and also improve the radiation efficiency of an antenna, and may improve SAR and HAC performance.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. A part or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A wireless terminal, comprising:
a first antenna and a second antenna;
a printed circuit board;
a bracket;
a resonator; and
wherein:
the first antenna is located at a first side edge of the printed circuit board,
the second antenna is located at a second side edge of the printed circuit board,
the printed circuit board functions as a metal ground of the first antenna and the second antenna,
the resonator is located on the bracket,
a ground point of the resonator is located on the printed circuit board,
a clearance exists between the resonator and the printed circuit board, and
the resonator comprises a structure formed by at least one metal strip that extends from a third side edge of the printed circuit board.

2. The wireless terminal according to claim 1, wherein the bracket is plastic bracket.

3. The wireless terminal according to claim 1, wherein the bracket is disposed on a surface of the printed circuit board or is disposed on a side edge of the printed circuit board that is perpendicular to the surface.

4. The wireless terminal according to claim 1, wherein the wireless terminal further comprises a housing, and the bracket is disposed on the housing of the wireless terminal.

5. The wireless terminal according to claim 1, wherein the bracket is a housing of the wireless terminal.

6. The wireless terminal according to claim 1, wherein:
the first antenna and the second antenna are separately located at two opposite side edges of the printed circuit board; or
the first antenna and the second antenna are separately located at two adjacent side edges of the printed circuit board.

7. The wireless terminal according to claim 1, wherein the ground point of the resonator is located on the printed circuit board and between the first antenna and the second antenna.

8. The wireless terminal according to claim 1, wherein the resonator is one of or any combination of the following:
a high and low frequency metal open stub, a closed metal stub, a metal stub in a form of a monopole antenna, or a metal stub in a shape of an inverted-F antenna.

9. The wireless terminal according to claim 1, wherein the resonator is outside the printed circuit board.

10. The wireless terminal according to claim 1, wherein the resonator is electrically connected to a lump component through a switch assembly, wherein the lump component comprises at least two matching circuits, and the switch assembly is configured to switch between the at least two matching circuits, so as to enable a resonance point of the resonator to switch between different working frequencies.

11. A wireless terminal, comprising:
a first antenna and a second antenna;
a printed circuit board;
a bracket;
a resonator; and
wherein:
the first antenna is located at a first side edge of the printed circuit board, the second antenna is located at a second side edge of the printed circuit board, the printed circuit board functions as a metal ground of the first antenna and the second antenna, the resonator is located on the bracket, a ground point of the resonator is located on the printed circuit board, the resonator is at least used to improve isolation between the first antenna and the second antenna, a clearance exists between the resonator and the printed circuit board, and the resonator comprises a structure formed by at least one metal strip that extends from a third edge of the printed circuit board.

12. The wireless terminal according to claim 11, wherein the bracket is plastic bracket.

13. The wireless terminal according to claim 11, wherein the bracket is disposed on a surface of the printed circuit board or is disposed on a side edge of the printed circuit board that is perpendicular to the surface.

14. The wireless terminal according to claim 11, wherein the wireless terminal further comprises a housing, and the bracket is disposed on the housing of the wireless terminal.

15. The wireless terminal according to claim 11, wherein the bracket is a housing of the wireless terminal.

16. The wireless terminal according to claim 11, wherein:

the first antenna and the second antenna are separately located at two opposite side edges of the printed circuit board; or the first antenna and the second antenna are separately located at two adjacent side edges of the printed circuit board.

17. The wireless terminal according to claim 11, wherein the ground point of the resonator is located on the printed circuit board and between the first antenna and the second antenna.

18. The wireless terminal according to claim 11, wherein the resonator is one of or any combination of the following:

a high and low frequency metal open stub, a closed metal stub, a metal stub in a form of a monopole antenna, or a metal stub in a shape of an inverted-F antenna.

19. The wireless terminal according to claim 11, wherein the resonator is outside the printed circuit board.

20. The wireless terminal according to claim 11, wherein the resonator is electrically connected to a lump component through a switch assembly, wherein the lump component comprises at least two matching circuits, and the switch assembly is configured to switch between the at least two matching circuits, so as to enable a resonance point of the resonator to switch between different working frequencies.

* * * * *